US008075241B2

(12) United States Patent
McKee

(10) Patent No.: US 8,075,241 B2
(45) **Date of Patent: *Dec. 13, 2011**

(54) METHOD OF OPERATING A WORKING MACHINE

(75) Inventor: Michael McKee, Crewe (GB)

(73) Assignee: J.C. Bamford Excavators Limited, Uttoxeter (GB)

( * ) Notice: Subject to any disclaimer, the term of this patent is extended or adjusted under 35 U.S.C. 154(b) by 171 days.

This patent is subject to a terminal disclaimer.

(21) Appl. No.: 12/125,433

(22) Filed: May 22, 2008

(65) Prior Publication Data

US 2008/0292436 A1 Nov. 27, 2008

(30) Foreign Application Priority Data

May 26, 2007 (GB) ..... 0710158.7

(51) Int. Cl.
*E02F 3/00* (2006.01)

(52) U.S. Cl. ..... 414/694; 414/687; 414/685; 37/903; 37/403

(58) Field of Classification Search ..... 414/680, 414/685, 694, 687, 912; 37/403, 405, 410, 37/903; 172/272–275; 180/327, 329, 330, 180/331

See application file for complete search history.

(56) References Cited

U.S. PATENT DOCUMENTS

| | | | | |
|---|---|---|---|---|
| 2,499,654 | A * | 3/1950 | Kuhlman | 224/410 |
| 3,669,286 | A * | 6/1972 | Gauchet | 414/694 |
| 5,104,024 | A * | 4/1992 | Brewer et al. | 227/2 |
| 5,108,253 | A * | 4/1992 | Kobayashi et al. | 414/694 |
| 5,265,995 | A * | 11/1993 | Beck | 414/694 |

FOREIGN PATENT DOCUMENTS

| | | | |
|---|---|---|---|
| DE | 10 2006 005 213 | A1 | 12/2006 |
| EP | 1 008 693 | A1 | 6/2000 |
| EP | 1 176 260 | A1 | 1/2002 |
| GB | 1 461 475 | | 1/1977 |
| GB | 2 352 224 | | 1/2001 |

(Continued)

OTHER PUBLICATIONS

Search Report for GB 0808634.0, dated Sep. 9, 2008.

(Continued)

*Primary Examiner* — Donald Underwood
(74) *Attorney, Agent, or Firm* — Marshall, Gerstein & Borun LLP

(57) ABSTRACT

A method of operating a working machine of the kind including a body, a ground engaging structure, the body carrying a superstructure which is rotatable relative to the body about a first generally upright axis, the superstructure providing a mounting for a working arm which permits the working arm to be pivoted up and down about a generally horizontal axis and to be rotated about a second generally upright axis, the working arm including a mounting structure for releasably carrying at an outermost end thereof, a working implement, the method including providing on the machine a working implement holding device, and rotating the superstructure relative to the body about the first generally upright axis, and manipulating the working arm about the generally horizontal axis and the second generally upright axis to bring the working implement carried by the working arm into holding engagement with the holding device whereby the holding device holds the working implement, releasing the working implement from the mounting structure, and manipulating the working arm to move the mounting structure away from the holding device.

7 Claims, 7 Drawing Sheets

FOREIGN PATENT DOCUMENTS

| | | |
|---|---|---|
| GB | 2 395 187 A | 5/2004 |
| JP | 2000-209963 | 8/2000 |
| JP | 2005-232950 | 1/2004 |
| JP | 2005-350919 | 6/2004 |
| WO | WO-01/38649 | 5/2001 |

OTHER PUBLICATIONS

Search Report for GB0808632.4, dated Sep. 9, 2008.
Search Report for GB0808635.7, dated Sep. 9, 2008.
Search Report for GB0710158.7, dated Sep. 20, 2007.

* cited by examiner

METHOD OF OPERATING A WORKING MACHINE

BACKGROUND TO THE INVENTION

This invention relates to a method of operating a working machine of the kind which has a working arm with a working implement carried at an outermost end thereof.

So called "quick couplings" are know which permit a working implement to be readily and releasably mounted on the outermost end of a working arm. When thus carried by the working arm, the implement may be used by manipulating the working arm, which may include a plurality of pivotally connected components. The implement too may be manipulated to perform working operations. Typically such quick couplings enable a range of working implements conveniently to be severally fitted to the working arm, and preferably without the need for difficult manual handling of the implement.

It will be appreciated that such a working machine needs to be driven or transported around e.g. a construction site or other working environment, and may need to be driven or transported from site to site.

Current practice requires that working implements of the machine, which are not carried by the working arm and are required at different locations, are transported separately from the machine. Hence there is a need to load an implement transporter with the implements. This is all inconvenient, and inefficient.

SUMMARY OF THE INVENTION

According to a first aspect of the invention we provide a method of operating a working machine. The machine may be of the kind including a body, a ground engaging structure, the body carrying a superstructure which is rotatable relative to the body about a first generally upright axis, and the superstructure may provide a mounting for a working arm which permits the working arm to be pivoted up and down about a generally horizontal axis and to be rotated about a second generally upright axis. The working arm may include a mounting structure for releasably carrying at an outermost end thereof, a working implement. The method may include providing on the machine a working implement holding device, and rotating the superstructure relative to the body about the first generally upright axis, and manipulating the working arm about the generally horizontal axis and the second generally upright axis to bring the working implement carried by the working arm into holding engagement with the holding device whereby the holding device holds the working implement, releasing the working implement from the mounting structure. The working arm may then be manipulated to move the mounting structure away from the holding device.

Thus utilising the method of the invention, there is no need to carry the working implement separately from the machine, but rather the implement can be transported whilst engaged and held by the holding device. Moreover, because the method requires the working arm to be manipulated to bring the working implement into engagement with the holding device, there is no need for any manual handling of the implement in order to transport it.

The invention therefore enables the implement to be transported with improved convenience and efficiency.

In order that the machine is capable of bringing the working implement into engagement with the holding device, the working arm preferably includes a boom part which is mounted to the superstructure at one end, and to one end of a dipper at or adjacent the other end, the dipper being pivotal relative to the boom at a first end of the dipper, about a further generally horizontal axis and carrying at a second end thereof, the working implement.

The working implement may be mounted to the second end of the dipper for movement about a yet further generally horizontal axis, and the method may include manipulating the working implement relative to the dipper to bring the working implement into holding engagement with the holding device.

The ground engaging structure of the machine may include first and second pairs of wheels, the wheels of each pair being provided at opposite sides of the machine, for example at the ends of respective axles of the ground engaging structure.

The body may mount a prime mover towards one end of the body, and the rotatable superstructure may be carried towards a second end of the body opposite the first end. For example the prime mover may be located generally over the first axle, or at least over or between the first pair of wheels towards the first end of the body, and the rotatable superstructure may be located generally over the axle, or at least over or between the second pair of wheels towards the second end of the body. In one example, the holding device may be provided at a location generally at one side of the body between the wheels of the first and second pair at the one side, but the holding device may be provided at any other location of the body or the machine where there is the required space to stow the relevant working implement.

Desirably the holding device is provided or at least extends about the level of a plane containing the axes of rotation of the wheels.

In one embodiment, the holding device may include a pair of holder parts and the working implement may be brought into holding engagement with the holding device by engaging at least a part of the working implement with each of the holder parts. Such an arrangement is particularly useful where the working implement to be held is for example a hammer drill. However the configuration of the holding device will depend on the configuration of the working implement to be held. For example the working implement may instead of being a hammer drill, may be an excavating bucket in which case the holding device may include formations engageable inside and/or with the outer surface of the bucket, to hold the excavating bucket.

According to a second aspect of the invention we provide a working machine including a body, a ground engaging structure, the body carrying a superstructure which is rotatable relative to the body about a first generally upright axis, the superstructure providing a mounting for a working arm which permits the working arm to be pivoted up and down about a generally horizontal axis and to be rotated about a second generally upright axis, the working arm including a mounting structure for releasably carrying at an outermost end thereof, a working implement, the machine further including a working implement holding device, the superstructure being rotatable relative to the body about the first generally upright axis, and the working arm being manipulatable about the generally horizontal axis and the second generally upright axis to enable the working implement carried by the working arm to be brought into holding engagement with the holding device whereby the holding device holds the working implement, and the working implement being releasable from the mounting structure to enable the working arm to be manipulated to move the mounting structure away from the holding device.

The working machine of the second aspect of the invention may have any of the features of the working machine used in performance of the method of the first aspect of the invention.

BRIEF DESCRIPTION OF THE DRAWINGS

Embodiments of the invention will now be described with reference on the accompanying drawings in which:—

DESCRIPTION OF THE PREFERRED EMBODIMENTS

Figure 1:
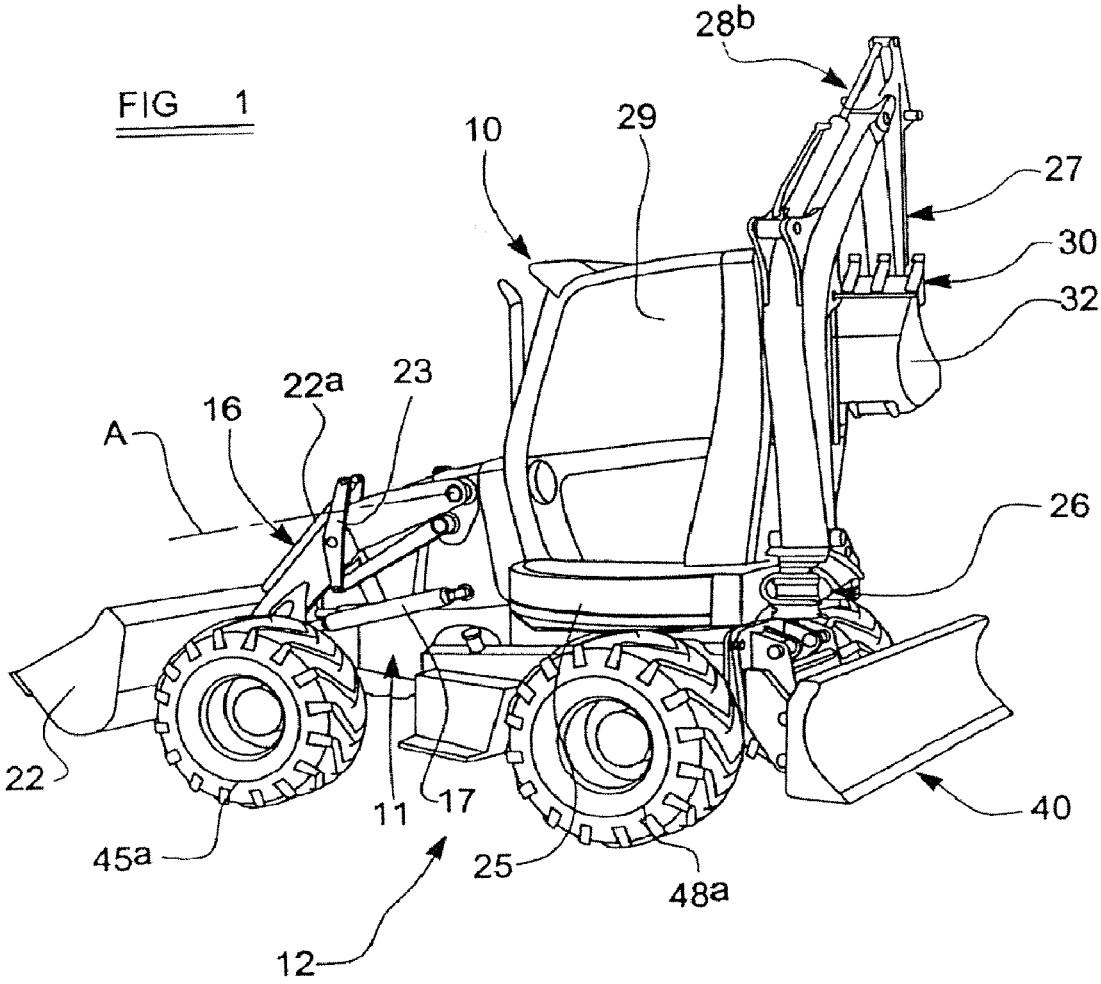
FIG. 1 is a perspective illustrative view of a working machine in accordance with the invention from a second end of the machine and the side.

Referring to the drawings, there is shown a working machine 10 which includes a body 11 which carries a ground engaging structure 12. The body 11 mounts a prime mover such as an engine 9, beneath a body housing part such as a bonnet 13. At one end 18 of the body 11 there is a provided a first working arm 16 which in this example will be referred to as a loading arm. The loading arm 16 is pivoted for up and down movement about a first generally horizontal axis A, and includes a pair of arm members 16*a*, 16*b*, each at a respective side of the bonnet 13. The arm 16 can be pivoted up and down about axis A by a pair of actuators 17 which each extends between the body 11 and a respective arm member 16*a*, 16*b* of the loading arm 16. It can be seen from FIG. 1 that when the loading arm 16 is lowered, the bonnet 13 and hence the prime mover 9 is received between the arm members 16*a*, 16*b* of the loading arm 16.

The loading arm 16 extends beyond the first end 18 of the body 11, and carries at its outermost end a first working implement 22, which in the example shown is a loading shovel. The loading shovel 22 is mounted to the loading arm 16 via a mounting structure 110 which permits the ready release of the loading shovel 22 for a purpose hereinafter described. The loading shovel 22 is pivotable about a generally horizontally extending shovel axis F, which movement is achieved by means of a pair of hydraulic linear actuators 22*a* via a linkage indicated at 23 by means of which the attitude of the loading shovel 22 may be maintained as the loading arm is pivoted up and down about the first generally horizontal axis A.

At a second end 24 of the body 11 opposite to the first end 18, the body 11 carries a superstructure 25. The superstructure 25 is rotatable relative to the body 11 about a first generally upright axis B, and the superstructure 25 also provides a mounting 26 for a second working arm 27. The mounting 26 is of the kind which permits the second working arm 27 to be pivoted up and down about a second generally horizontal axis C by an actuator 27*a* which acts between the superstructure 25 and the second working arm 27, and to be rotated about a second generally upright axis D relative to the superstructure 25 by means of push-pull linear actuators which are not readily seen in the drawings.

The second working arm 27 carries at its outer most end 30, a second working implement 32 which in the present example is an excavating bucket, but could be a hammer drill or other working implement as desired.

The superstructure 25 also mounts an operator's cab 29. Within the cab 29 there is provided an operator position P which includes an operator seat 34 and controls 35, operable by an operator when occupying the seat 34 to manipulate the various actuators 17, 22*a*, 27*a* of the working arms 16 and 27, as well as to cause the superstructure 25 to rotate about the first generally upright axis B relative to the body 11.

The operator's cab 29 is mounted with respect to the superstructure 25 for rotation about a third generally upright axis E which in the present example is coincident with the second generally upright axis B about which the superstructure 25 rotates relation to the body 11 but which in another example could be offset longitudinally and/or laterally of the machine relative to axis B. Rotation of the superstructure 25 relative to the body 11 is achieved by a hydraulic motor which acts between the body 11 and the superstructure 25; rotation of the operator's cab 29 relative to the superstructure 25 is achieved with a second hydraulic motor which acts between the cab 29 and the superstructure 25, although in both cases, if desired, rotation of the superstructure 25 and/or the cab 29 might be achieved with linear actuators.

The second working implement e.g. bucket 32 or a hammer drill, is mounted to the second working arm 27 by a mounting structure 100 which again preferably is the kind which releasably mounts the excavating bucket 32 or other second working implement.

The second working arm 27 includes a boom 28 which is mounted to the superstructure 25 at the mounting 26, at one end 28*a* of the boom 28.

At the other end 28*b* of the boom 28, the boom 28 is mounted pivotally to a dipper 31. The pivot axis between the boom 28 and dipper 31 is a fourth generally horizontal axis indicated at G in the drawings. The dipper 31 may be pivoted relative to the boom 28 by means of a dipper actuator 31a which acts between the boom 28 and the dipper 31. The dipper 31 carries at a second end thereof, the second working implement 32 and the second working implement 32 is pivotable about a generally horizontal axis H relative to the dipper 31 by means of a hydraulic actuator 32*a* which acts between the dipper 31 and the second working implement 32.

Figure 9:
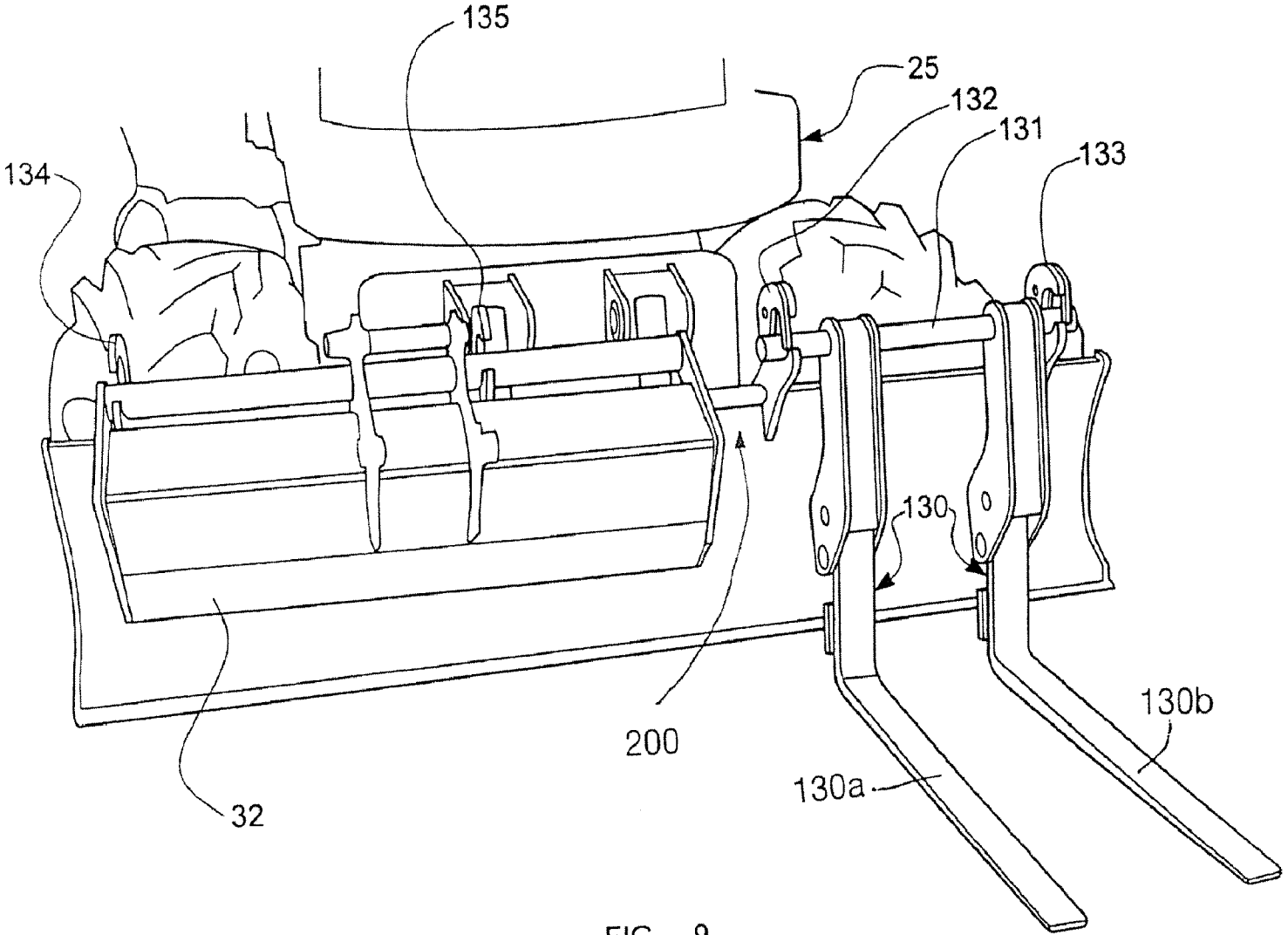
FIG. 9 is an illustrative view of another end of the machine showing forks and excavating bucket mounted on a mounting structure.

The machine 10 includes a third working implement 40 which is provided at the second end 24 of the machine 10. The third working implement 40 is a grading or dozer blade which extends across substantially the entire width of the machine as best seen for example, in FIG. 2. The blade 40 is mounted on a mounting structure 41 which not only permits the blade 40 to pivot relative about a further generally horizontal axis J relative to the body 11 of the machine 10, but also the blade 40 may be raised and lowered by operating an actuator 40*a* which acts between the body 11 and the blade 40 via a linkage 40*b*. The implement 40 and mounting structure 41 together provide a further mounting assembly 200, as best seen in FIG. 9.

The ground engaging structure 12 includes a first pair of wheels 45*a*, 45*b* provided at either end of an axle 46, and in this example, the axle 46 is pivotable relative to the body 11 via a generally conventional generally central pivot mount so that the axle 46 may oscillate relative to the body 11 in response to encountering variations in ground level as the machine 10 moves over the ground.

The ground engaging structure further includes a second pair of wheels 48*a*, 48*b* carried on a rigid axle 47. In this example, all four wheels 45*a*, 45*b* and 48*a* and 48*b* are drivable by a transmission from the engine 12 and are each steerable via a steering mechanism by the operator at the operating position 32 turning a steering wheel 35*a*.

Different operating modes of the machine will now be described.

Figure 2:
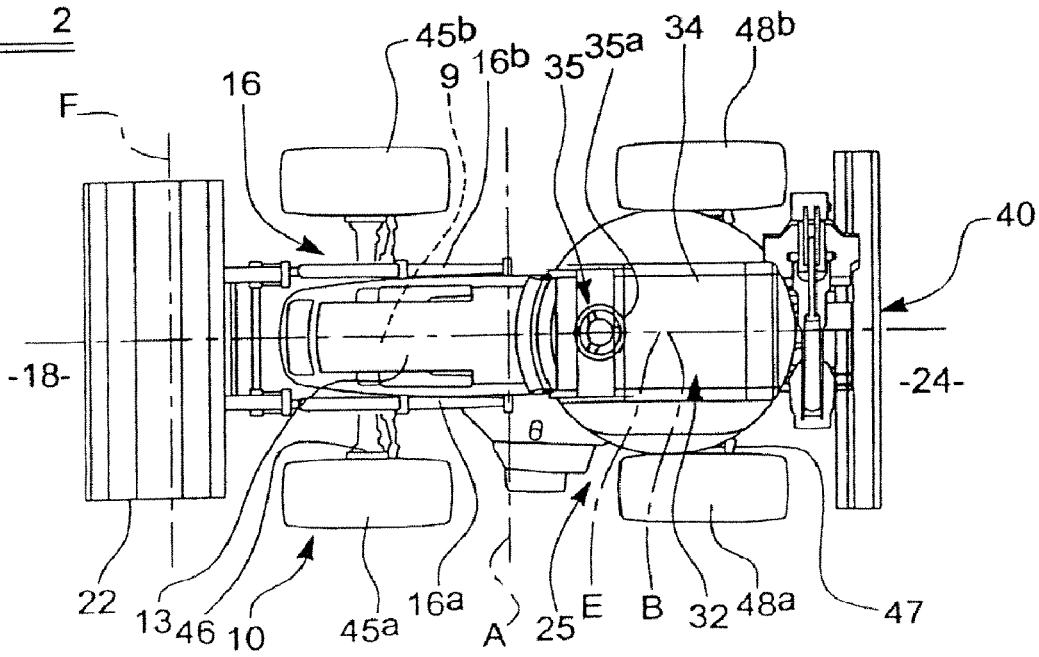
FIG. 2 is a plan view of the machine of FIG. 1.

In a first operating mode, in which the machine may perform loading operations using the loading shovel 22, the superstructure 25 is rotated to the position shown in FIG. 1 in which the joint 26 is provided adjacent the one wheel 48*a* of the second pair of wheels, so that the second working arm 27 and second working implement 32 can be stowed in the compact condition shown in FIGS. 1 and 2. To achieve this, the boom 28 and dipper 31 and second working implement 32 will need to be manipulated to raise the boom 28 and to fold the dipper 31 and the second working implements 32.

The operator's cab 29 may then be rotated about the third generally upright axis E in order to bring the operator's position P to face the first end 18 of the machine 10. In this condition, the operator may manipulate the controls 35 in order to operate the various loader actuators 17 and 22*a* in order to perform loading operations by pivoting the loading arm 16 about the first horizontal axis A and by pivoting the loading bucket 22 about the generally horizontal axis F.

In this condition, the superstructure 25 and operator's cab 29 will be locked in the positions described. Generally, the third working implement 40 will be raised clear of the ground during the performance of loading operations and because the superstructure 25 is rotated to the position described, the second working arm 27 will not obstruct the vision of the operator when performing working operations.

Figure 3:
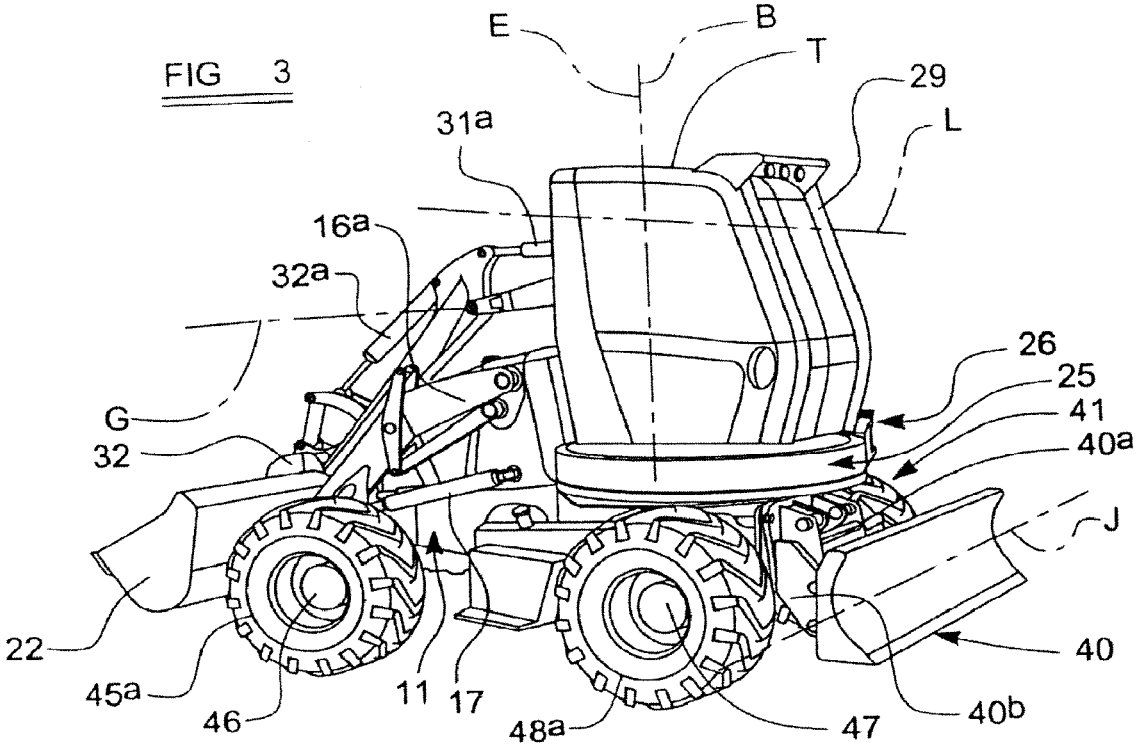
FIG. 3 is a view similar to FIG. 1 but showing the machine operating in a different mode of operation.
Figure 4:
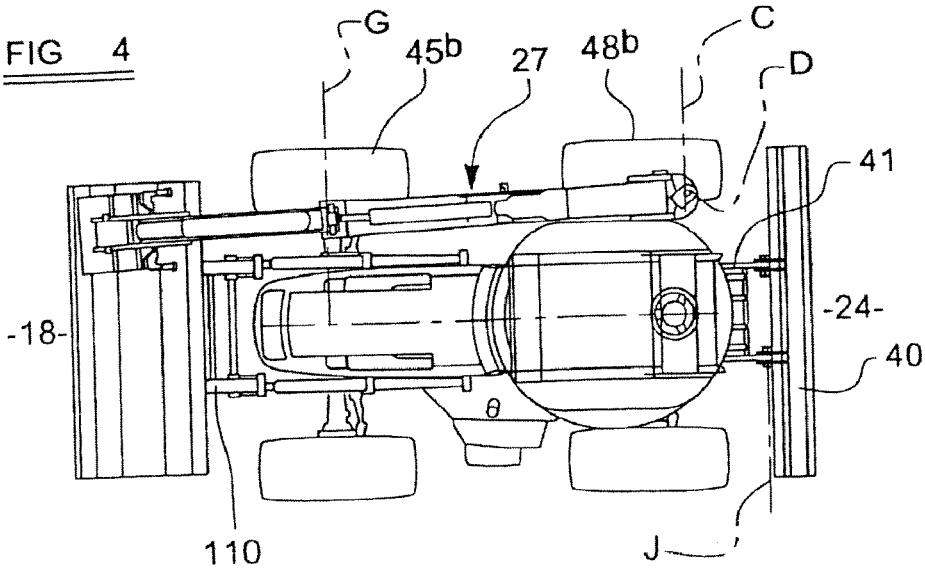
FIG. 4 is a plan view of the machine in the mode of operation depicted in FIG. 3.

In a second operating mode when the machine 10 is configured as indicated in FIGS. 3 and 4, the superstructure 25 is rotated relative to the body 11 to the position shown in which the joint 26 will be over opposite wheel 48*b* of the second pair of wheels. In this position, the boom 28 and dipper 31 may be manipulated, as well as the second working implement 32 to adopt the condition shown in which the second working implement 32 is stowed in the loading shovel 22 at the one end 18 of the machine 10.

The operator's cab 29 is then rotated to bring the operating position 32 to face the second end 24 of the machine 11. In this condition, the machine 10 may be driven in a direction with the second end 24 of the machine 10 leading, which in this example, is the usual forwards direction of travel of the machine 10 on-road.

The second working arm 27 and second working implement 32 thus are stowed by the side of the operator's cab 29 during travelling of the machine 10, e.g. on a road, and do not present any obstruction to the operator's sight at least in forwards and mostly sideways directions. It can be seen that the excavating arm 27 is configured and/or is of such a length that in the second operating condition shown in FIGS. 3 and 4, no part of the second working arm 27 extends above a top T of the operator's cab 29, and moreover, no part of the excavating arm 27 extends above a line L indicative of the top of the operator's head when sat in his seat 34.

Being driven in this configuration, having the pivoted axle 46 towards the rear end 18 of the machine 10 provides stability advantages.

In the second operating condition shown in FIGS. 3 and 4, the loading arm 16 is lowered but the loading shovel 22 is well clear of the ground, and the blade 40 is raised sufficiently clear of the ground to present no potential obstruction.

Figure 5:
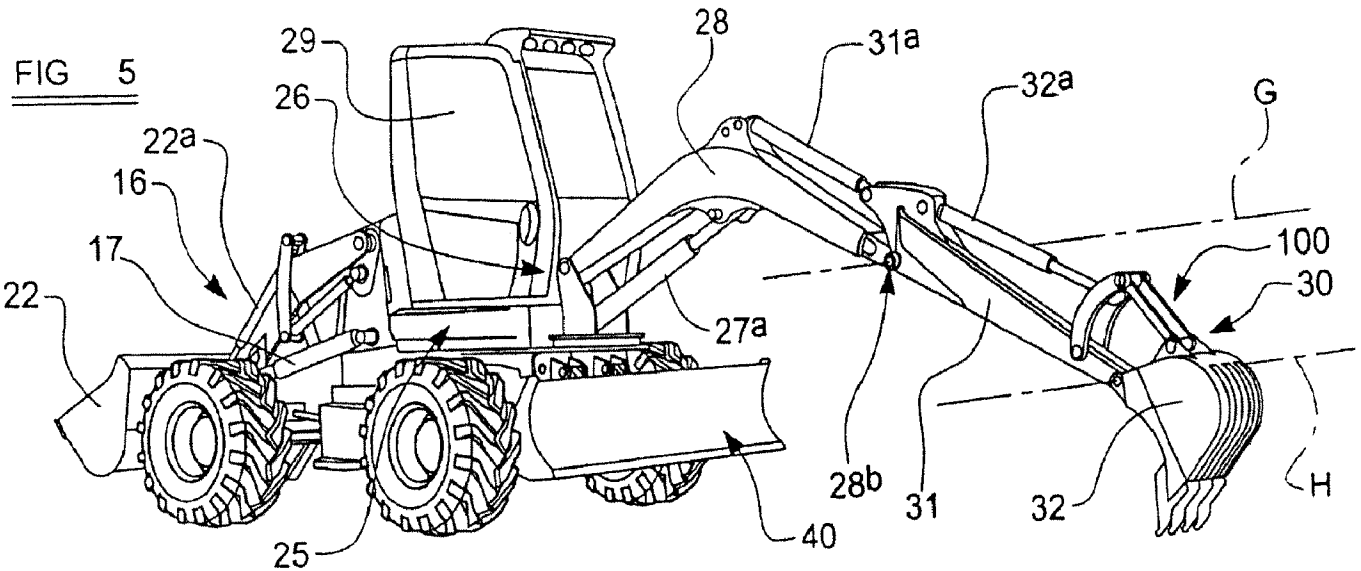
FIG. 5 is yet another view similar to FIG. 1 again showing the machine operating in a another different mode of operation.
Figure 6:
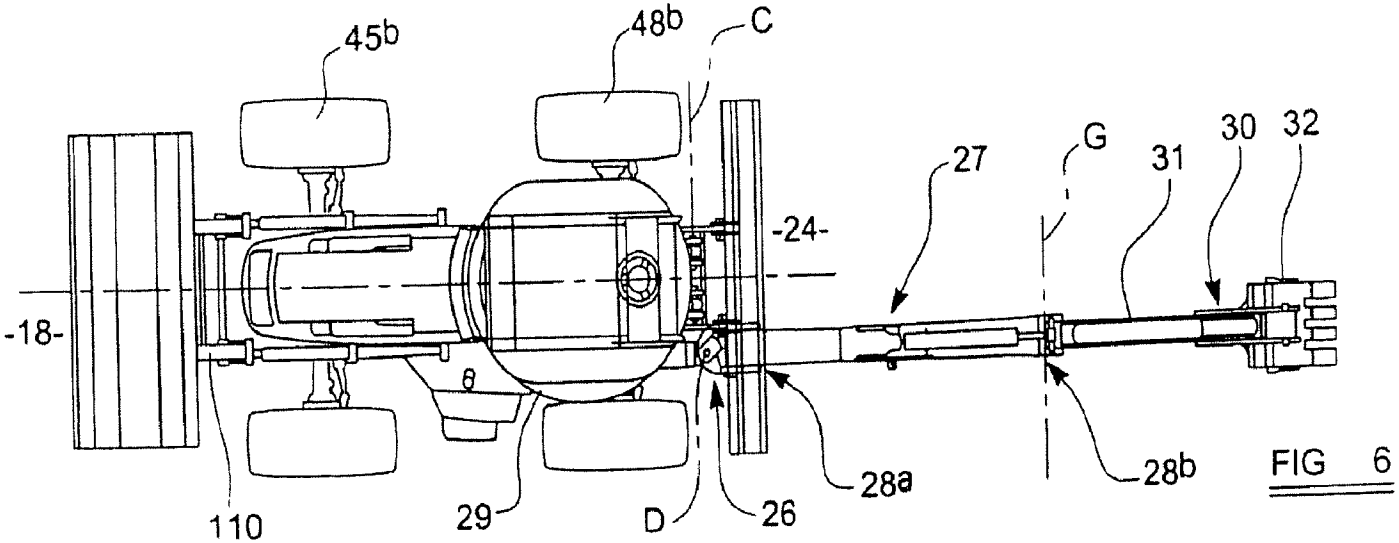
FIG. 6 is a plan view of the machine in the mode of operation depicted in FIG. 5.

In a third mode of operation when the machine will be configured, for example as shown in FIGS. 5 and 6, the superstructure 25 may be rotated about its generally upright axis B relative to the body 11 to bring the second working arm 27 to any desired position throughout the range of rotation possible, so that the second working arm 27 may be used for excavating operations. Desirably the operator's cab 29 is rotated relative to the superstructure 25 to bring the operator's cab 29 to a position behind the second working arm 27 to that the operator position P will be behind the second working arm 27 generally, as the second working arm 27 performs its operations.

During excavating, using the second working arm 27, typically the third working implement 40, i.e. the grading/dozer blade 40 will be lowered into contact with the ground. Furthermore, the loading shovel 22 may also be lowered into contact with the ground, in each case to improve stability of the machine 10.

During the third mode of operation, the operator's cab 29 will generally be locked relative to the superstructure 25 so that the cab 29 and superstructure 25 will rotate together during excavating operations.

The controls 35 within the operator's cab 29 may include in addition to the steering wheel 35*a*, foot pedals, transmission controls and other controls necessary for driving the machine 10 in the second operating mode as described above. The loading arm 16 and second working arm 27 may be manipulated via joystick controls which may be connected to the hydraulic control valve assembly via pilot servo hydraulic service lines, or electrical servo service lines.

When the superstructure 25 and/or cab 29 are rotated about their respective axis B and E it will appreciated that continuity of the service line communication between on the one hand the cab 29 and the superstructure 25 and on the other hand between the superstructure 25 and the body 11, is required.

A service line switching structure S is therefore required so that for example, when the operator's cab 29 is facing the first end 18 of the machine 10, as in the first operating mode described above, the joystick or other controls 35 are operable to control the hydraulic actuators 17 and 22*a*, but when the operator's cab 29 is facing the second end 24 of the machine 10, or at least other than facing the front end 18 of the machine 10, the controls 35 are operable to control the hydraulic actuators 31*a*, 32*a* and 27*a* for manipulating the second working arm 27 and the second working implement 32.

It will be appreciated that in the second operating mode particularly as described above, if instead of the second working implement 32 being an excavating bucket as shown in FIGS. 1 to 6, a rather longer working implement is provided at the end 30 of the second working arm 27, it might not be possible to accommodate the second working implement 32 in the loading shovel 22. Moreover, if a plurality of working implements are provided which may, for alternative work operations, be carried by the excavating arm 27 by means of the releasable mounting structure 100, when moving the machine 10 from site to site it would be necessary separately to transport each of the working implements which are not being carried at the end of the excavating arm. This can be very inefficient.

Figure 7:
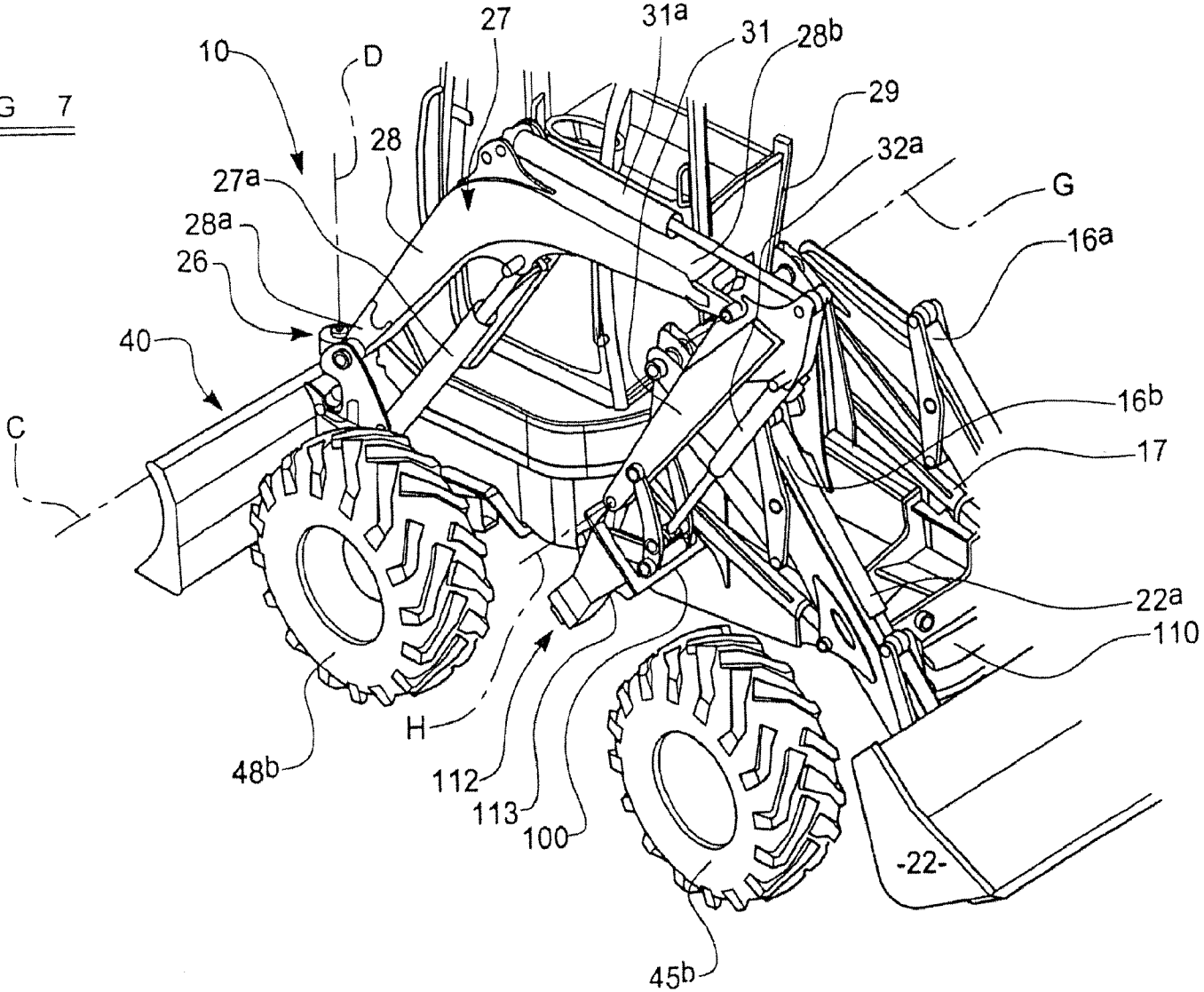
FIG. 7 is a illustrative perspective view from a first end and the rear of part of the machine, showing the machine performing a particular operation.

In FIG. 7 it can be seen that the machine 10 has a holding device 112. In this example, the holding device 112 is secured to the side of the body 11 between the wheels 45*b* and 48*b* at the left hand side of the machine 10 when considered travelling in its usual forward direction with the second end 24 of the body 11 leading.

The holding device 112 provides an internal chamber into which a working implement can be inserted by manipulating the second working arm 27 as shown in FIG. 7.

When the implement 32 is inserted in the chamber, the mounting structure 100 may be operated to release the working implement 32 and the second working arm 27 may then move the mounting structure 100 away from the holding device 112 either for stowage in the loading shovel 22 as shown in FIG. 4 or 5, or in order that the second working arm 27 may be used to carry an alternative second working implement 32. Thus in FIG. 7, the second working implement is shown to be a hammer drill attachment 113 and the holding device 112 is correspondingly configured to receive the hammer drill attachment 113. When the mounting structure 100 releases the hammer drill attachment 113, the mounting structure 100 may then engage an alternative working implement such as the excavating bucket 32 already described.

The shape and configuration of the holding device 112 will of course depend upon the nature of the second working implement to be held thereby. For example, where a holding device 112 is for holding a working implement which is an excavating bucket 32, the holding device 112 may include formations to engage the inside and/or outside of the excavating bucket 32 as required.

Figure 7A:
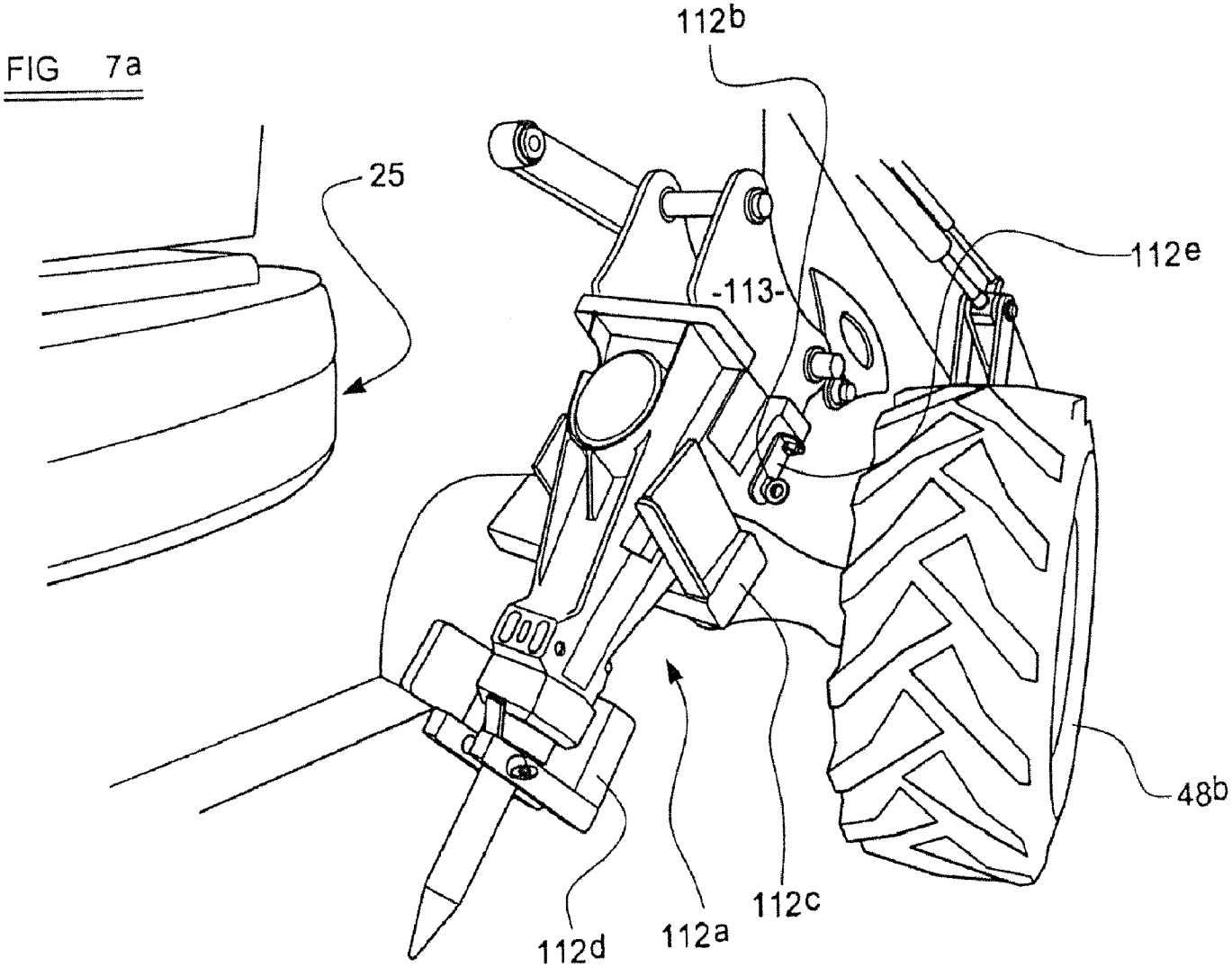
FIG. 7*a* is an illustrative perspective view of a holding device for holding a hammer drill attachment.

FIG. 7*a* shows an alternative holding device 112*a* for a hammer drill attachment 113 which is provided by two holder parts 112*c*, 112*d* which support the attachment 113, and a locking device 112*e* which includes a locking pin 112 to lock the attachment 113 in the holding device 112*e*.

Of course any number of holding devices 112/112*a* may be provided on the body 11 for which there is space for example, behind or in front of the dozer blade 40, or elsewhere on the machine 10 and thus a plurality of working implements 32 may be transported by the machine 10 either held by the holding device(s) 112/112*a* or carried out the outermost end 30 of the second working arm 27.

The mounting structure 100 may be a manually operable structure although preferably is hydraulically operated by means of a hydraulic actuator operating and/or releasing a latch. The configuration of so called "quick connectors" is well known.

In place of the loading shovel 22, the mounting structure 110 at the end of the loading arm 16 may instead carry an alternative first working implement 22 such as a loading forks. Such loading forks may be mounted by the mounting structure 110 so as to be pivotable about a generally horizontal axis to lift and engage loads such as pallets.

The loading forks generally includes a pair of fork elements 130*a*/130*b* which may comprise integral L-shaped components which are mounted by a mounting member at the uppermost ends of the fork elements. The mounting structure 110 may include a plurality of recesses which, at least when the loading shovel 22 is disengaged from the mounting structure 110, can receive the mounting member of the loading forks working implement. Thus the loading arm 16 may be used for loading operations utilising the loading forks instead of the loading shovel 22 as formerly described.

In another example, the mounting structure 110 may be capable of simultaneously mounting the loading shovel 22 and a loading forks, with the fork elements being moveable between a stowed position essentially behind the loading shovel 22 and an operative position in front of the loading shovel 22. Alternatively, the stowed loading forks may only be utilisable after the loading shovel 22 has been disengaged from the mounting structure 110.

Figure 8:
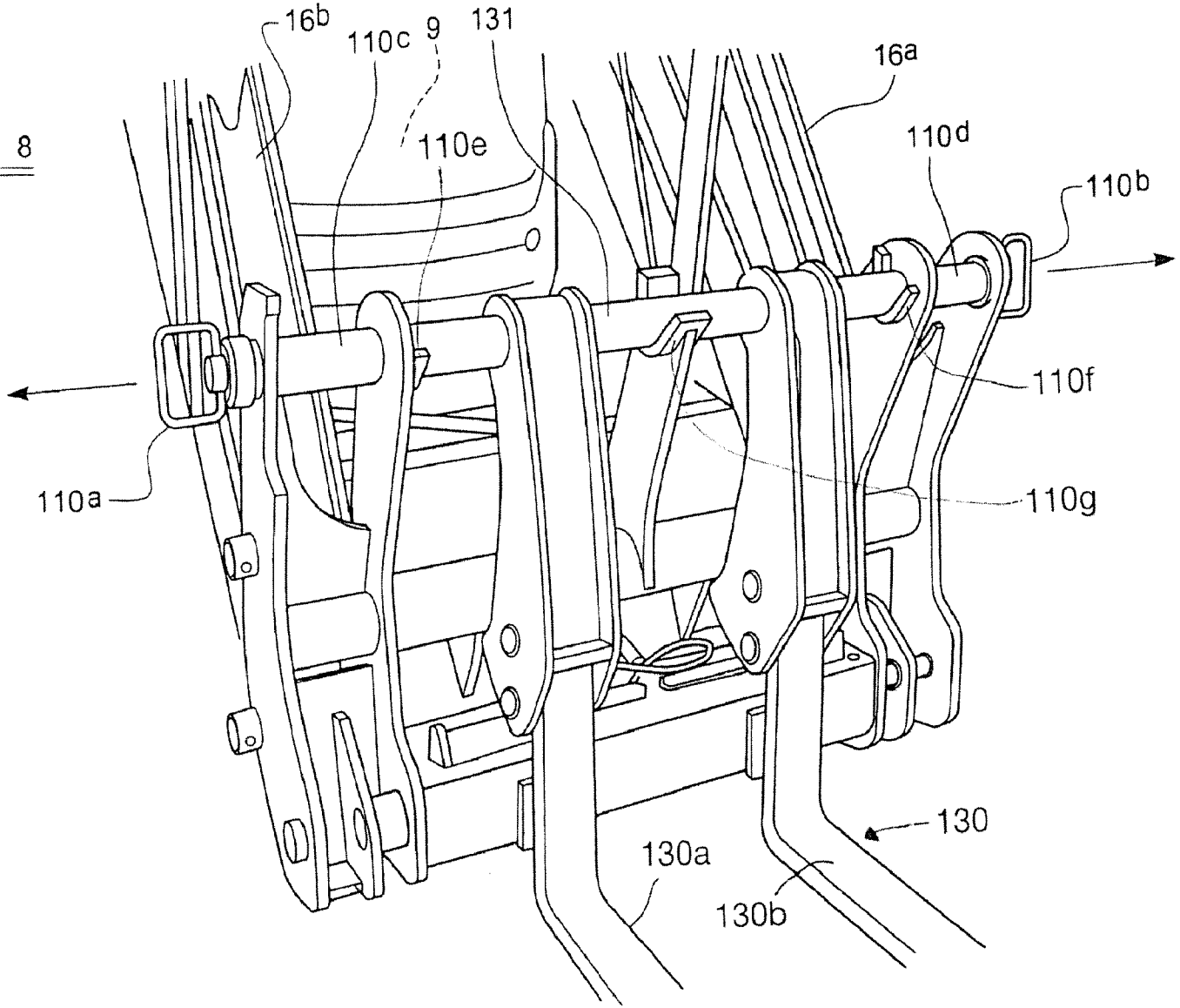
FIG. 8 is an illustrative view of one end of the machine where loading forks are mounted.

In FIG. 8, a pair of loading forks 130 are shown mounted on mounting structure 110 from which the loading shovel 22 has been disengaged. Individual fork elements 130*a*, 130*b* of the pair 130 are shown folded forward from an inoperative position behind the shovel 22, to an operative position as shown. The forks 130 are provided on a mounting member 131 which is separable from the remainder of the mounting structure 110. This is achieved by removing a pair of latch locking pins 110*a*, 110*b*, by longitudinal movement, indicated by the respective arrows. The pins 110*a*, 110*b* extend into the inside of the mounting member 131, and when the pins 110*a*, 110*b* are removed, the mounting member 131 is released.

The mounting structure 110 includes a pair of receiving formations 110*c* and 110*f*, and a central support 110*g* to support the mounting member 131 when the latches 110*a*, 110*b* are released.

When the mounting member 131 and forks 130 are removed, the remainder of the mounting structure 110 may again be used to mount the shovel 22, as shovel support parts 110*c*, 110*d*, through which the pins 110*a*, 110*b* otherwise extend into the mounting member 131, will remain, to receive mounting formations of the shovel 22.

The third working implement, i.e. the dozer/grading blade 40 mounting structure 41 may also provide recesses 132, 133 (see FIG. 9) capable of receiving the mounting member 131 for the loading forks working implement 130. Preferably such recesses 132, 133 are provided on the blade 40, by the further mounting structure 41 in a position such that the loading forks 130 may be simultaneously carried by the further mounting structure 41 so that it is unnecessary to remove the grading/dozer blade 40 before carrying loading forks 130.

Desirably, the second working arm 27 i.e. the mounting structure 100, and/or the second working implement carried at the outermost end 30 of the second working arm 27, are manipulatable by the operator to disengage the loading forks 130 from the mounting structure 110 at the one end 18 of the machine 10, and to transport the loading forks 130, on the mounting member 131, to the second end 24 of the machine 10 where they may be received by the blade 40 and/or the further mounting structure 41 of the third working implement 40. Such manipulation may involve the relative pivoting of the mounting structure 110 which may or may not be mounting the second working implement 32, the dipper 31 and the boom 28, movement of the second working arm 27 about its mounting 26 and around both generally horizontal C and generally upright axis D, and also swivelling of the superstructure 25 as necessary. However, this enables a single loading forward working implement i.e. forks 130 to be provided, which is useable at both the first end 18 and the second end 24 of the body 11, and no or minimal manual handling of the loading forks is required in order to transport them from the first end 18 of the body 11 to the second end 24 of the body 11.

It will be appreciated that with the loading forks 130 mounted by the blade 40 and/or further mounting structure 41 of the third working implement 40, the machine 10 may be operated in the first mode described above utilising the or a further loading shovel 22 to be carried at the outer end of the loading arm 16, and the machine 10 may be operated in the second and third operating modes too.

The machine 10 of the invention is particularly useful for operations involving the laying of paving when the loading forks 130 may be received by the further mounting structure 41 of the third working implement 40 and the second working arm 27 may be manipulated to transport sand and the like material stowed and held in the loading shovel 22 to the second end 24 of the machine 10. In this way it has been found that the machine 10 may be used for working functions including the laying of paving without the need for frequent repositioning of the machine 10 to bring respective working implements 22, 32, 40 to locations adjacent a position where work operations are carried out.

Various modifications are possible without departing from the scope of the invention.

As described in the example, the loading arm 16 includes a pair of spaced arm members 16*a*, 16*b*, but in another example, the loading arm 16 may be provided by a single loading arm member which may be received for example to one side of the bonnet 13 or other body housing part and the prime mover 12.

In the example described, the prime mover 9 is an engine, but in another example could be an alternative kind of prime mover such as an electric motor.

The particular configuration of the loading arm 16 shown is only exemplary, as is the particular configuration of the second working arm 27. In another example, in place of or in addition to the grading/dozer blade 40, the machine 10 may be provided with stabilisers for use during excavating operations using the second working arm 27 and second working implement 32.

The boom 28 of the second working arm 28 need not be of the "banana" shape shown although this is useful for ensuring that the overall length of the second working arm 27 and its configuration does not obscure sight lines of the operator at least when the machine is in its second working configuration described above.

In another example, the machine 10 may only be steerable by two wheels. The axles 46, 47 could be suspended from the body 11 if desired. In the example shown, the wheels 45 and 48 are small so as to provide maximum stability during, for example, excavating operations, but could be larger.

If desired, the machine 10 may include sensors to indicate if the machine 10 is becoming laterally unstable for example when the second working arm 27 is performing excavating operations at either side of the machine 10.

In the example described, the superstructure 25 is not able to rotate relative to the body 11 through a full 3600, but rather rotation is restricted to about 270°. Thus rotatable couplings in order to provide continuity of hydraulic and/or electrical services between the superstructure 25 and body 11 need not be provided, but hydraulic connections may be made by hoses and electrical connections by cables. Similarly, the operator's cab 29 preferably is not rotatable through 3600 relative to the superstructure 25, but is only rotatable through about 180°, but possibly up to 270° again to facilitate to conveyance of services between the superstructure 25 and operator's cab 29 without involving expensive rotatable type couplings.

In this example, the third working implement i.e. dozer blade 30 and/or the further mounting structure 41 may provide further recesses 134, 135 to receive and retain the second working implement, e.g. where this is an excavating bucket, as indicated in FIG. 8, alongside the forks 130 where there are mounted at the end 24 of the machine 10.

Thus when the excavating arm 27 is carrying, for example, the hammer attachment 113, the excavating bucket 32 may be stowed and carried in the second end 24 of the machine 10, on the further mounting assembly 200 of the third working implement 30 and mounting structure 41.

The further recesses 134, 135 of the further mounting assembly, may have latches to lock the mounting member 131 relative to the further mounting assembly 200.

The excavating bucket 32 may be moved to its stowed position as shown in FIG. 8, by manipulating the excavating arm 27.

The invention claimed is:

1. A method of operating a working machine of the kind including a body, a ground engaging structure including first and second pairs of wheels, the wheels of each pair being provided at opposite sides of the machine, the body mounting a first working arm which is pivotable about a first generally horizontal axis and carrying, in use, a first working implement, the body also carrying a superstructure which is rotatable relative to the body about a second generally upright axis, the superstructure providing first and second mounts, the first mount mounting a cab to be rotated relative to the superstructure about a third generally upright axis and the second mount mounting a second working arm to be pivoted up and down about a third generally horizontal axis and to be rotated about a fourth generally upright axis, the second working arm including a mounting structure for releasably carrying at an outermost end thereof, a second working implement, the method including providing on the machine a working implement holding device secured to one side of the body between the wheels of the first and second pairs on the one side, rotating the superstructure relative to the body about the second generally upright axis, rotating the cab relative to the superstructure about the third generally upright axis, and manipulating the second working arm about the third generally horizontal axis and the fourth generally upright axis to bring the second working implement carried by the second working arm into holding engagement with the holding device whereby the holding device holds the second working implement, releasing the second working implement from the mounting structure, and manipulating the second working arm to move the mounting structure away from the holding device.

2. A method according to claim 1 wherein the method includes transporting the second working implement whilst engaged and held by the holding device.

3. A method according to claim 1 wherein the second working arm includes a boom part which is mounted to the superstructure at one end, and to one end of a dipper at or adjacent the other end, the dipper being pivotal relative to the boom at a first end of the dipper, about a further generally horizontal axis and carrying at a second end thereof, the second working implement, the second working implement being mounted to the second end of the dipper for movement about a yet further generally horizontal axis, and the method including manipulating the second working implement relative to the dipper to bring the second working implement into holding engagement with the holding device.

4. A method according to claim 1 wherein the body mounts a prime mover towards one end of the body, and the rotatable superstructure is carried towards a second end of the body opposite the first.

5. A method according to claim 4 wherein the holding device is provided or at least extends above the level of a plane containing the axes of rotation of the wheels.

6. A method according to claim 4 wherein the holding device includes a pair of holder parts and the method includes bringing the working implement into holding engagement with the holding device by engaging at least a part of the working implement with each of the holder parts.

7. A working machine including a body, a ground engaging structure, including first and second pairs of wheels, the wheels of each pair being provided at opposite sides of the machine, the body mounting a first working arm which is pivotable about a first generally horizontal axis, and carrying in use, a first working implement, the body also carrying a superstructure which is rotatable relative to the body about a second generally upright axis, the superstructure providing first and second mounts, the first mount mounting a cab to be rotated relative to the superstructure about a third generally upright axis and the second mount mounting a second working arm to be pivoted up and down about a third generally horizontal axis and to be rotated relative to the superstructure about a fourth generally upright axis, the second working arm including a mounting structure for releasably carrying at an outermost end thereof, a second working implement, the machine further including a working implement holding device secured to one side of the body between the wheels of the first and second pairs on the one side, the superstructure being rotatable relative to the body about the second generally upright axis, and the second working arm being manipulatable about the third generally horizontal axis and the fourth generally upright axis to enable the second working implement carried by the second working arm to be brought into holding engagement with the holding device whereby the holding device holds the second working implement, and the second working implement being releasable from the mounting structure to enable the second working arm to be manipulated to move the mounting structure away from the holding device.

* * * * *